US007288289B2

(12) United States Patent
Hudson et al.

(10) Patent No.: US 7,288,289 B2
(45) Date of Patent: Oct. 30, 2007

(54) METHOD AND APPARATUS FOR MANUFACTURING SHEET FLOORING BY SIMULTANEOUS MULTI-LAYER DIE COATING

(75) Inventors: R. Suter Hudson, Lancaster, PA (US); Robert E. Waters, Mount Joy, PA (US); Lowell E. West, Elizabethtown, PA (US)

(73) Assignee: AWI Licensing Company, Wilmington, DE (US)

( * ) Notice: Subject to any disclaimer, the term of this patent is extended or adjusted under 35 U.S.C. 154(b) by 301 days.

(21) Appl. No.: 09/862,234

(22) Filed: May 22, 2001

(65) Prior Publication Data

US 2002/0176945 A1 Nov. 28, 2002

(51) Int. Cl.
*B05D 1/36* (2006.01)
*B05D 7/00* (2006.01)

(52) U.S. Cl. ..... 427/407.1; 427/372.2; 427/375; 427/379

(58) Field of Classification Search ..... 427/407.1, 427/372.2, 375, 379
See application file for complete search history.

(56) References Cited

U.S. PATENT DOCUMENTS

| | | | | | |
|---|---|---|---|---|---|
| 2,761,417 | A | | 9/1956 | Russell et al. | 118/410 |
| 3,632,467 | A | * | 1/1972 | Todd et al. | 161/167 |
| 3,870,591 | A | | 3/1975 | Witman | 161/119 |
| 4,146,451 | A | * | 3/1979 | Schirmer | 521/79 |
| 4,176,210 | A | * | 11/1979 | Skinner | 427/258 |
| 4,620,993 | A | * | 11/1986 | Suss et al. | 427/407.1 |
| 4,681,811 | A | * | 7/1987 | Simpson et al. | 428/413 |
| 4,781,987 | A | | 11/1988 | Bolgiano et al. | 428/424.6 |
| 4,855,165 | A | | 8/1989 | Bolgiano et al. | 427/393.5 |
| 5,120,811 | A | | 6/1992 | Glotfelter et al. | 528/25 |
| 5,143,758 | A | | 9/1992 | Devine | 427/420 |
| 5,223,322 | A | | 6/1993 | Colyer et al. | 428/141 |
| 5,331,080 | A | * | 7/1994 | Swarup et al. | 528/89 |
| 5,494,707 | A | | 2/1996 | Wang et al. | 427/412.1 |
| 5,506,030 | A | | 4/1996 | Landers et al. | 428/143 |
| 5,571,588 | A | | 11/1996 | Lussi et al. | 428/46 |
| 5,589,122 | A | * | 12/1996 | Leonard et al. | 264/146 |
| 5,643,677 | A | * | 7/1997 | Feifer et al. | 428/424.6 |
| 5,663,003 | A | | 9/1997 | Ehrhart et al. | 428/482 |
| 5,719,227 | A | * | 2/1998 | Rosenberry et al. | 524/590 |
| 5,728,430 | A | * | 3/1998 | Sartor et al. | 427/356 |
| 5,733,608 | A | | 3/1998 | Kessel et al. | 427/547 |
| 5,773,127 | A | | 6/1998 | Martin et al. | 428/158 |

(Continued)

FOREIGN PATENT DOCUMENTS

WO WO 94/28067 12/1994

OTHER PUBLICATIONS

European Search Report Communication—Application No. EP 02 00 7939.8-2113 dated Oct. 13, 2003.

*Primary Examiner*—Elena Tsoy

(57) ABSTRACT

Surface coverings and surface covering components and methods for forming them using slot die coating are disclosed. The methods involve applying a plurality of wet layers to a substrate simultaneously or in sequence using a slot die coater, wherein a plurality of wet layers can be applied before any of the individual layers are dried, gelled, cured and/or fused. The layers remain separate and distinct before and after drying, gelling, curing and/or fusing, and can be dried, gelled, cured and/or fused together or separately after wet on wet application to the substrate. The surface coverings may be decorative surface covering, including floor coverings.

43 Claims, 6 Drawing Sheets

U.S. PATENT DOCUMENTS 5,817,399 A 10/1998 Kalman ..... 428/143
5,830,937 A * 11/1998 Shalov et al. ..... 524/297
5,843,576 A 12/1998 Rosenberry et al. ..... 428/423.1
5,871,585 A 2/1999 Most et al. ..... 118/410
5,891,582 A 4/1999 Ehrhart et al. ..... 428/482
5,951,507 A * 9/1999 Hilston et al. ..... 602/52
5,962,075 A 10/1999 Sartor et al. ..... 427/356
6,132,804 A 10/2000 Rice et al. ..... 427/245
6,287,706 B1 * 9/2001 Simpson et al. ..... 428/516
6,531,214 B2 * 3/2003 Carter et al. ..... 428/336

* cited by examiner

Slot Die Coater

Slot Die

Top View

End View

EXTRUSION SLOT COATING

Coating)

METHOD AND APPARATUS FOR MANUFACTURING SHEET FLOORING BY SIMULTANEOUS MULTI-LAYER DIE COATING

FIELD OF THE INVENTION

This invention relates to a surface covering and surface covering component and a method for producing a plurality of adjacent coating layers on a substrate to form the surface covering or surface covering component such that the coating layers remain separate and distinct before and after drying, curing, gelling and/or fusing of the layers.

BACKGROUND OF THE INVENTION

In the production of surface coverings, particularly decorative surface coverings and more particularly floor coverings, multiple coating layers are desirable to add different features, such as design and/or color elements and durability (wear) to the product. A decorative surface covering typically includes one or more special coatings, each of which is designed to provide a desired mechanical strength and/or decorative effect. These coatings are typically applied one at a time, with each coating being separately applied and cured before adding an adjacent coating layer. Such a procedure has been deemed necessary to maintain a distinct relationship between the separate layers and to prevent mixing of the coatings or contamination of one coating by another at the interface of the layers. These layers are typically applied by reverse roll coaters, forward roll coaters, blade over roll coaters, air knife coaters and other application methods known in the art. Certain coating layers, such as those containing abrasive materials, may need to be applied by a different method than other coating layers, requiring different coating application equipment in the production line. The multiplicity of coating applicators and curing stations is costly, requiring much capital, building space, and time to produce a single decorative surface covering product.

Where surface coverings or surface covering components are manufactured by individually laying down multiple layers on a substrate, each layer is laid down separately by passage through a roll coater, then fused, gelled or cured by processing over massive heated drums and/or in long forced air ovens. To lay down several layers, multiple passes of the goods through several production lines is required. Thus, the process is costly due to the high capital cost of roll coaters and factory space needed to house them. Further, scrap loss is incurred due to multiple passes through the rollers.

Roll coating also limits the types of coatings that may be applied to a support because roll coaters are inherently sensitive to the rheology of the applied liquid layers. High viscosity materials often cannot be used. This makes it difficult to use high performance wear-layer coatings that include high molecular weight, high viscosity materials. Additionally, add-on equipment to monitor and control the roll coaters is required to control the application thickness of each layer.

Slot die coating is a continuous coating technique which delivers quantitatively precise amounts of a material, typically of low solids and viscosity characteristics, to an applicator which deposits quantitatively precise amounts of the material on a traveling web or other substrate through an opening or slot in the applicator through which the fluid material exits. Typically, slot die coating is limited to smooth, nonporous surfaces such as photographic films, papers and circuit boards, and coatings including noninteractive chemistries. The use of slot die coating in photographic films allows coating layers of low viscosity films in thicknesses of one micron or less to be applied to a substrate. See, for example, U.S. Pat. Nos. 2,761,417 and 5,143,758. Typically a slide or cascade slot die coater is used to apply a plurality of wet on wet layers for photographic films. Slot die coaters have also been used for the manufacture of high performance composite membranes, which have a total thickness of less than 1 micron, and include multiple layers applied sequentially to a substrate. See, for example, U.S. Pat. No. 6,132,804. Further, slot die coating has been used to apply adhesive coatings to a substrate, as illustrated, for example, in U.S. Pat. Nos. 5,728,430, 5,871,585 and 5,962,075. Typically, the coating layers are applied at the tangent of the substrate roll and the slot die opening. Slot die coating has not been used for the application of viscous and/or high molecular weight materials, such as plastisols.

It would be advantageous to provide a method for reducing the capital, building space and time required to produce a decorative surface covering product. It would further be advantageous to provide a method for applying high solids and high viscosity coating layers, each with its own specific thickness, which does not require additional control measures. The present invention provides such methods.

SUMMARY OF THE INVENTION

Methods for applying a plurality of fluid coating compositions to the surface of a substrate in superposed, separate and distinct layer relationship are described. Any form of coating apparatus can be used that can form each fluid coating composition into a wet layer of desired thickness and allow the layers to be brought into surface contact with each other and to be directly or indirectly overlaying the substrate before curing of any one layer. The resulting wet-on-wet multi-layer coating exhibits physical and chemical properties comparable to, and in some embodiments improved over, those achieved by forming a plurality of layers of fluid coating compositions by applying each fluid coating composition as a layer and thoroughly curing the individual layer before the next layer is applied.

The methods involve obtaining a plurality of fluid coating compositions and applying each composition in the form of an individual layer onto a suitable substrate to form a plurality of separate and distinct layers directly or indirectly overlying the substrate. Each layer typically ranges from about 1.0 mil to about 25 mils wet thickness, or from about 0.1 mil to about 25 mils dry thickness. The layers can either be applied sequentially or simultaneously. In some embodiments, the fluid coating compositions are applied while the substrate is unsupported. The methods can be used to apply a topcoat and/or a wear layer that includes a plurality of coating layers to a substrate. A wear layer typically ranges from about 10 mils to about 25 mils wet thickness, and a topcoat layer typically ranges from about 1.0 mil to about 5 mils wet thickness.

After the layers are applied, they can be cured at the same time. Alternatively, one or more layers can be separately cured from other layers by subjecting the plurality of layers to different curing protocols, such as but not limited to heat and irradiation, at different times after all layers have been applied in wet-on-wet state to the substrate.

The plurality of fluid coating compositions can include one or more plastisols, water-based compositions, solvent based compositions, and/or 100% solids compositions. In one embodiment, each of the plurality of fluid coating compositions independently comprises a water-based or a 100% solids composition. In another embodiment, at least one fluid coating composition comprises a plastisol. In yet another embodiment, at least one fluid coating composition comprises a 100% solids composition. In a further embodiment, at least one fluid coating composition comprises a water-based composition.

Decorative surface coverings and decorative surface covering components comprising a plurality of coating layers adhered to a substrate, wherein the coating layers are cured together to form superposed, separate and distinct layers, are also disclosed. In one embodiment, the thickness of each coating composition layer independently is from about 1.0 mil to about 25 mils wet thickness, or from about 0.1 mil to about 25 mils dry thickness.

The decorative surface coverings or decorative surface covering components can include at least one fluid coating composition that comprises a plastisol. In one embodiment, all of the fluid coating compositions are independently either water-based or 100% solids compositions. In another embodiment, at least one fluid coating composition comprises a 100% solids composition. In a further embodiment, at least one fluid coating composition comprises a water-based composition.

The methods set forth herein permit the user to apply a plurality of fluid coating compositions sequentially or simultaneously in layers onto a substrate without curing each layer independently. This reduces capital, space and time needed to produce a final product, as well as reducing waste.

BRIEF DESCRIPTION OF THE DRAWINGS

The Figures are intended to illustrate various embodiments of the claimed invention. The invention is not limited to the illustrated Figures, but encompasses variations as may be apparent to practitioners in the art upon review of this disclosure. The Figures are as follows:

DETAILED DESCRIPTION OF THE INVENTION

Figure 1:
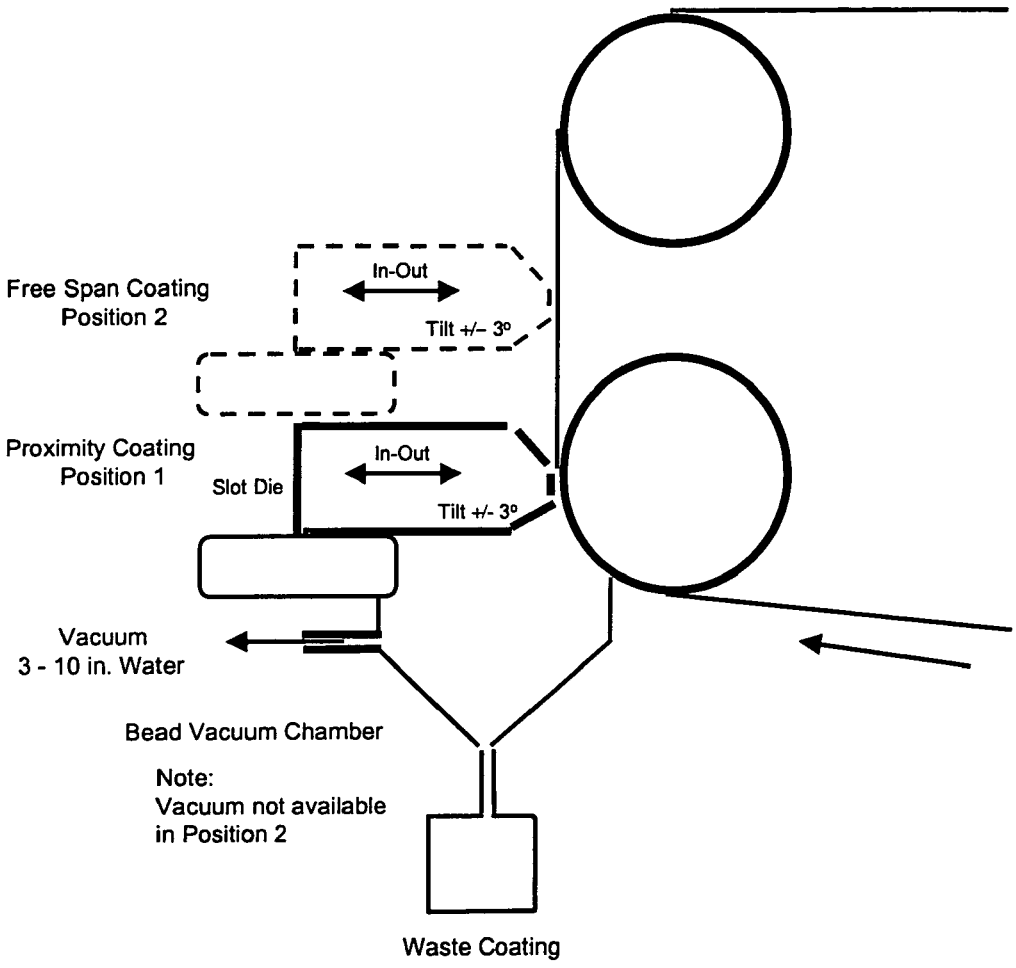
FIG. 1 illustrates an embodiment of a slot die coater.

Surface coverings and surface covering components and methods and apparatus for forming them by coating of a plurality of wet layers on a substrate are set forth in detail herein with reference to the attached Figures. All patents cited herein are hereby incorporated by reference in their entirety.

Slot die coating and gravity feed coating methods are known, but not for manufacturing a multi-layer surface covering or surface covering component using wet on wet applications of a plurality of coating layers to a substrate. The coating layers can be dried, gelled, fused and/or cured together or separately after application to a substrate.

As used herein the term "curing" means drying, gelling, fusing and/or curing, in whole or in part. Similar terms, such as "cured" and "curable," have similar meanings.

The coating layers may each independently be formed using water-based, solvent-based or 100% solids fluid coating compositions. In one embodiment, at least one coating layer is a plastisol. Although slot die coating is herein exemplified, practitioners in the art will recognize that the methods and apparatus set forth herein are not so limited.

The methods described herein successfully apply techniques such as slot die coating to high viscosity coating layers such as those used to manufacture surface coverings and surface covering components, including decorative surface coverings and decorative surface covering components such as flooring, wall coverings and the like. Decorative surface coverings and decorative surface covering components are known to practitioners in the art. The use of slot die coating to manufacture decorative surface coverings and decorative surface covering components, in particular, to simultaneously or sequentially apply a plurality of layers, typically comprising at least one layer comprising a plastisol, to a substrate, is heretofore unknown in the art. Although decorative surface coverings and decorative surface covering components are herein exemplified, practitioners in the art will recognize that the methods, materials and apparatus set forth herein are applicable to other surface coverings and surface covering components.

Coating Compositions

Virtually any type of fluid coating composition used to prepare decorative surface coverings or decorative surface covering components as known to practitioners in the art can be applied using the methods described herein. The compositions can comprise water-based, solvent-based and/or 100% solids compositions as are known in the art.

Examples of suitable water- and solvent-based fluid coating compositions are described, for example, in U.S. Pat. Nos. 4,781,987, 4,855,165 5,120,811, 5,223,322 and 5,643,677. Examples of suitable 100% solids fluid coating compositions can be found, for example, in U.S. Pat. Nos. 5,891,582 and 5,719,227. Other suitable water-based, solvent-based and 100% solids compositions for use in decorative surface coverings and decorative surface covering components are known to practitioners in the art. In one embodiment, at least one fluid coating composition comprises a 100% solids composition. In another embodiment, at least one fluid coating composition comprises a water-based composition. In a further embodiment, each fluid coating composition individually comprises either a 100% solids composition or a water-based composition. In certain embodiments, at least one fluid coating composition comprises a solvent-based composition. Typically, a topcoat comprises at least one fluid coating composition comprising a solvent-based composition.

In a further embodiment of the invention, at least one fluid coating composition comprises a plastisol. Suitable plastisol compositions include those described in U.S. Pat. No. 5,223,322, for example. Other plastisol compositions known to practitioners in the art are also suitable for use.

Suitable fluid coating compositions further include those known in the art to form layers such as strengthening layers (U.S. Pat. Nos. 3,870,591 and 5,494,707, for example), foaming layers, wear layers (U.S. Pat. Nos. 5,494,707, 5,643,677, 5,719,227 and 5,843,576, for example), decorative coating layers and topcoats, including high performance topcoats (U.S. Pat. Nos. 4,781,987, 5,120,811, 5,494,707, 5,663,003 and 5,891,582, for example) and the like, as known to practitioners in the art.

The fluid coating compositions can include additives such as, but not limited to, abrasive coating materials, colored particles, hard particles, opalescent or pearlescent particles, glitter, metallic particles, flatting agents, glossing agents, blowing agents and other additives as known in the art.

The methods described herein can be used to apply one or more coating layers independently selected from the types of layers typically used to prepare decorative surface coverings and decorative surface covering components as described herein and known to practitioners in the art. For example, high performance decorative surface coverings or high performance decorative surface covering components that include a plurality of special purpose layers can be manufactured by wet on wet slot die application of a plurality of coating layers, sequentially or simultaneously, onto a substrate.

As used herein, the phrases "a plurality of fluid coating compositions", "one or more fluid coating compositions" when more than one fluid coating composition is contemplated, and phrases with the same intended meaning, are defined to mean two or more fluid coating compositions, each of which form a separate and distinct layer when coated on a substrate, wherein at least one fluid coating composition differs in composition from the remaining fluid coating compositions. A difference in rheology or viscosity only between two fluid coating compositions, achieved through a change in the temperature of, or the use of additives in, one fluid coating composition, wherein the fluid coating compositions are otherwise chemically identical, does not constitute a different fluid coating composition for purposes of this disclosure.

As used herein, the phrases "a plurality of coating layers", "one or more coating layers" when more than one coating layer is contemplated, and phrases with the same intended meaning, are defined to mean two or more coating layers wherein at least one coating layer comprises a fluid coating composition different in composition from that of the remaining layers.

Substrates

Substrates suitable for use herein include all substrates known to practitioners in the art, including but not limited to solid, filled or unfilled polymeric layers or composites; solid layer composites comprising fibrous webs saturated with polymeric binder; one or more porous fibrous layers, such as but not limited to beater saturated felts; non-woven fabric materials; paper; solid backings, such as but not limited to vinyl, optionally made on a release carrier, and combinations thereof, which typically are coated with additional layers such as wear layers, strengthening layers and decorative layers.

Other suitable substrates include decorative surface covering components that comprise at least a substrate, preferably in combination with one or more coating layers, such as but not limited to a wear layer, strengthening layer, foamable layer, decorative layer or any combination thereof.

A decorative surface covering component is any portion of a decorative surface covering. For example, a decorative surface covering component can be a substrate, a substrate with one or more coating layers, or one or more coating layers without a substrate. The coating layers can include any layers suitable for formation of a decorative surface covering as known in the art, such as but not limited to a wear layer, a strengthening layer, a decorative layer, a foamable layer, a topcoat or any combination thereof.

Decorative Surface Coverings or Decorative Surface Covering Components

A decorative surface covering or decorative surface covering component includes a decorative covering typically used as flooring, wall covering or the like, as known to practitioners in the art. Desired features include strength, durability and visual appeal.

Decorative surface coverings and decorative surface covering components prepared using the methods described herein can include virtually any combination of layers comprising the fluid coating compositions described herein. For example, the decorative surface coverings or decorative surface covering components can include combinations of water-based and solvent-based layers, water-based and 100% solids layers, solvent-based and 100% solids layers, or water-based, solvent-based and 100% solids layers in any order. The decorative surface coverings or decorative surface covering components can further include one or more plastisol layers in combination with one or more water-based layers, one or more solvent based layers, one or more 100% solids layers or combinations thereof.

The number of coating composition layers applied to a substrate can range from two to four layers or more, depending on the thickness, viscosity and rheology of each fluid coating composition and the desired effect in the finished product. Each layer can be from about 1.0 mil to about 25 mils wet thickness, or from about 0.1 to about 25 mils dry thickness, although thicker or thinner layers can be used if desired. The total dried thickness of the plurality of coating layers is dependent upon the percent solids content of the fluid coating composition, but typically can be from about 0.2 mil to about 100 mils. A thinner or thicker plurality of coating layers can be achieved if desired. Typically, the dried thickness of the plurality of coating layers is from about 0.2 mil to about 50 mils.

Where one or more wear layer composition is applied to a substrate or decorative surface covering component, each wear layer composition is typically applied in a wet thickness from about 10 mils to about 25 mils, although a thinner or thicker coating can be applied if desired. Where one or more topcoat composition is applied to a substrate or decorative surface covering component, each topcoat composition is typically applied in a wet thickness of from about 1.0 mil to about 5 mils, although a thinner or thicker coating can be applied if desired.

Each coating layer independently can have a viscosity of from about 500 to about 20,000 cPs. Typically, the viscosity of a water-based or solvent-based coating layer ranges from about 500 to about 5000 cPs, more typically from about 2000 to about 5000 cPs. 100% solids coating layers suitable for use herein can have a viscosity as high as 20,000 cPs or greater. Typically, the viscosity of a 100% solids coating layer ranges from about 5000 to about 20,000 cPs. Coating layers of water-based, solvent-based or 100% solids compositions with higher and lower viscosities than those mentioned above are also suitable for use herein, as will be appreciated by practitioners in the art.

Methods for Applying the Coating Layers

A plurality of coating layers can be applied to a substrate simultaneously. That is, two or more fluid coating compositions can be applied to a substrate from a multi-cavity slot die such that the individual layers from the multi-cavity slot die form a single wet stream that is applied to the substrate. Within the single wet stream, each coating layer remains separate and distinct from the remaining coating layers. Examples of multi-cavity slot die apparatuses used for simultaneous coating of layers include those of U.S. Pat. Nos. 5,871,585, 5,728,430 and 5,962,075. As known to practitioners in the art, an apparatus resulting in a single wet stream comprising multiple fluid coating compositions for application to a substrate is a multi-cavity slot die.

A plurality of coating layers also can be applied sequentially to a substrate using one or more slot dies to apply the fluid coating compositions as layers onto the substrate one at a time. An example of a sequential slot die coating apparatus is shown in U.S. Pat. No. 6,132,804. When applied sequentially, all of the coating layers are contacted with the substrate or another coating layer supported by the substrate before any coating layer is cured. The coating layers each remain separate and distinct as applied to the substrate both before and after the layers are cured.

Separate and distinct, as used herein, means that no coating layer combines with any other coating layer in a wet or dry state to any appreciable degree, such that, if examined in cross section, the interface between one coating layer and an adjacent coating layer is readily apparent. It is understood that some intermixing of the layers occurs on a molecular level at the interface.

In one embodiment, one or more additional layers can be applied, if desired, by any means known in the art after the initial plurality of coating layers has been cured. For example, an ultraviolet (UV) curable topcoat layer can be applied and cured after a plurality of layers is applied to a substrate by the methods disclosed herein and cured.

Alternatively, one or more additional layers can be applied by any means known in the art after application of one or more fluid coating compositions to a substrate and before curing of the one or more fluid coating compositions on the substrate. In this embodiment, at least one coating layer already present on the substrate is cured with the one or more additional layers applied at a separate time.

Figure 3:
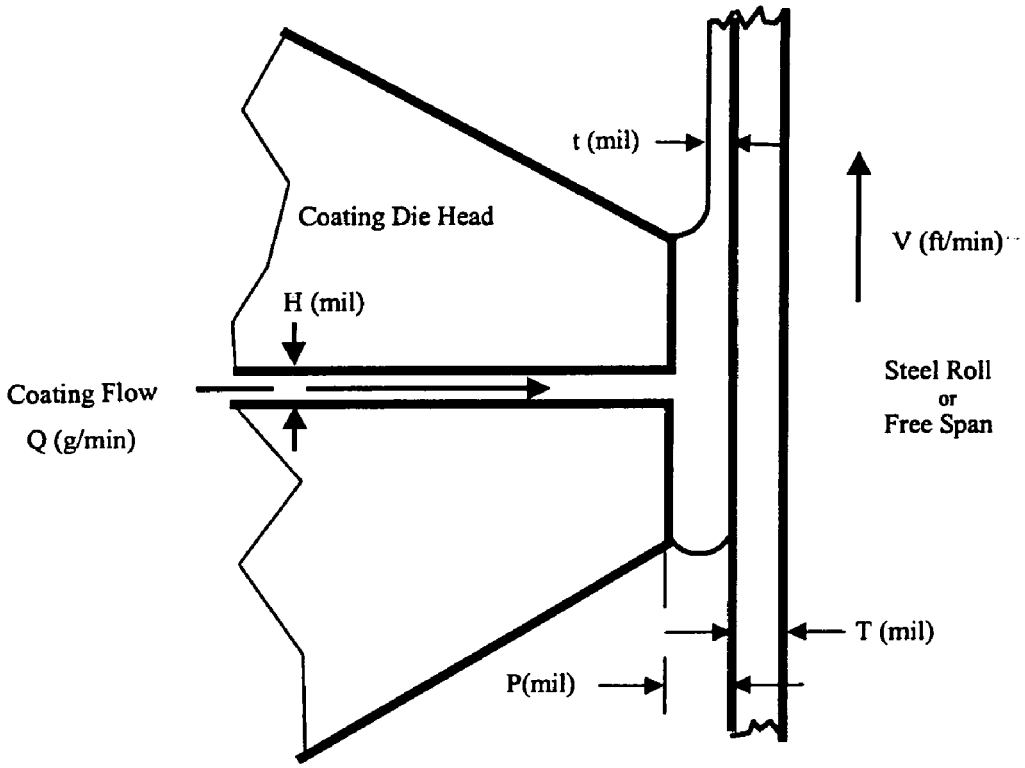
FIG. 3 illustrates multi-layer slot die coating as used in an embodiment of the invention.
Figure 6:
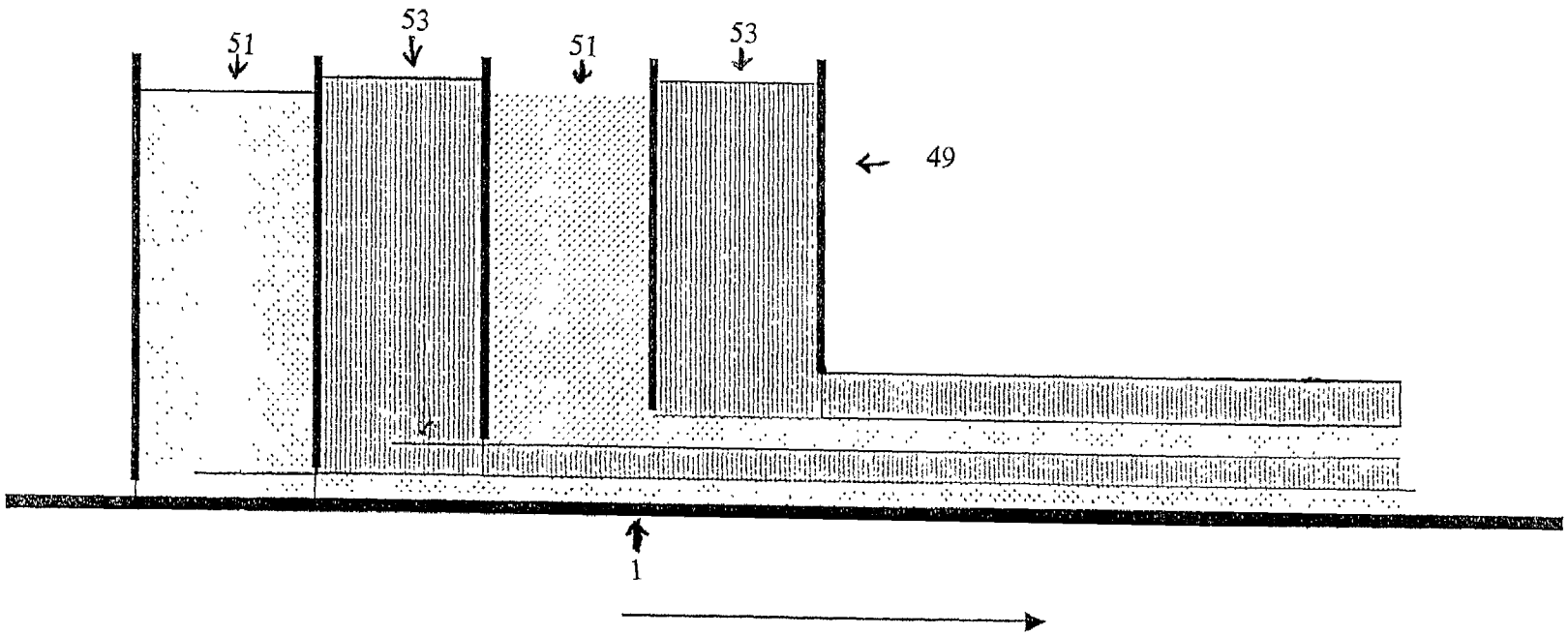
FIG. 6 illustrates multi-layer coating application using gravity fed hoppers. Like features are numbered uniformly throughout the Figures.

A plurality of wet coating layers can be applied to a substrate at room temperature using a plurality of single cavity dies (see FIG. 1) or a multiple-cavity die (see FIGS. 3 and 6). As shown in FIG. 1, the slot die 11 includes two "lips" 23 which define the slot die opening 25. The lips 23 are placed adjacent to the substrate 1, and separated therefrom during manufacture by the fluid coating composition 27. The fluid coating composition 27 is supplied by distribution channel 15 to slot die opening 25 formed by lips 23 for application to substrate 1. The slot die opening 25 and substrate 1 have substantially equal widths so that the entire cross width of the substrate 1 is coated in one pass by the fluid coating composition 27 as it flows out of the slot die opening 25 and onto the moving substrate 1.

Figure 2:
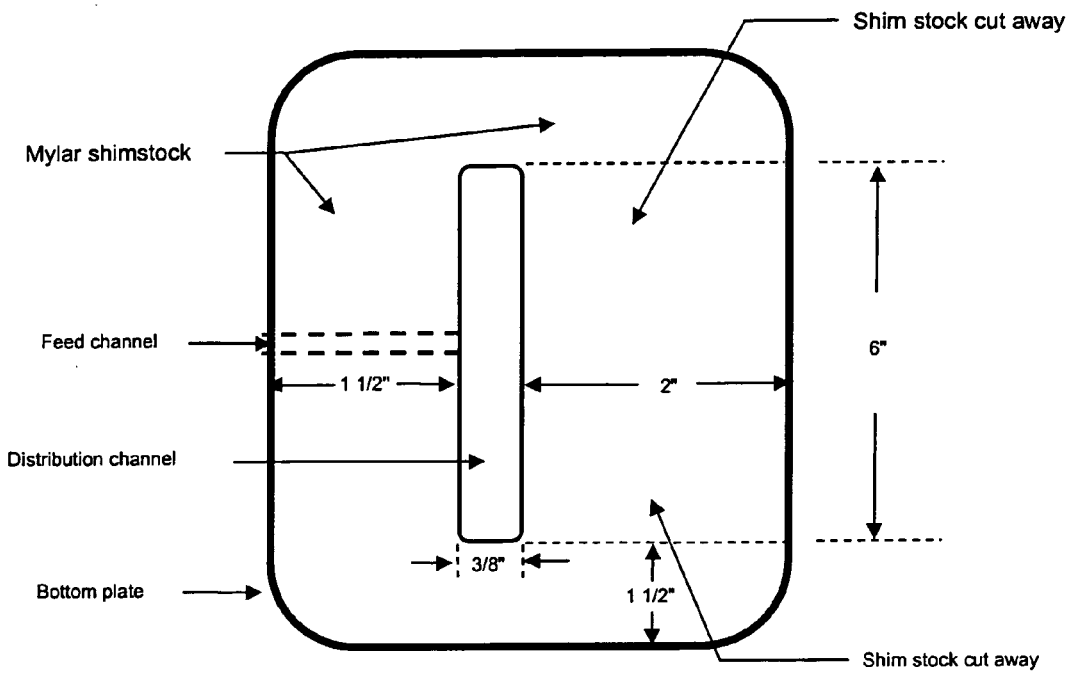
FIG. 2A is a section view of a slot die as used in an embodiment of the invention taken along line 2A-2A of FIG. 2B.
FIG. 2B is a side view of the slot die of FIG. 2A.
Figure 2:
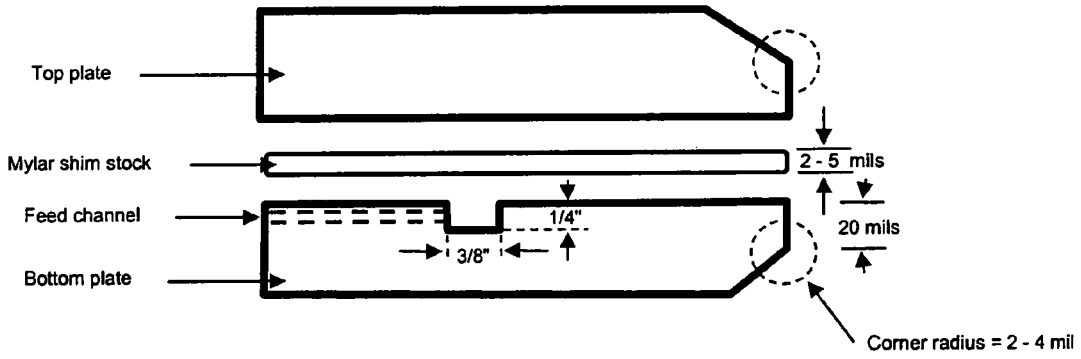

As shown in FIGS. 2A and 2B, the slot die 11 is modular in that it can be assembled from a number of individual elements and then set in an apparatus for coating as an integral device. As shown in FIGS. 2A and 2B, the slot die 11 includes a distribution channel 15 and a feed channel 13, which feeds the fluid coating composition from a reservoir into the distribution channel 15. The distribution channel 15 is an opening milled into the bottom portion 19 of the slot die 11. The capacity of the distribution channel can be adjusted using one or more shims 21, preferably U-shaped, which are inserted into the distribution channel 15. The distribution channel 15 spreads the fluid coating uniformly along the slot die opening 25 between the top portion 17 and the bottom portion 19 of the slot die 11 in the space formed by the shim 21. The fluid coating composition flows into the distribution channel 15 and exits between the slot die lips 23 at slot die opening 25.

FIG. 3 shows a multi-cavity slot die 11 with slot die lips 23, slot die openings 25A and 25B, and distribution channels 15A and 15B. Distribution channel 15A carries fluid coating composition 27A to slot die opening 25A, and distribution channel 15B carries fluid coating composition 27B to slot die opening 25B, from which the fluid coating compositions 27A and 27B, respectively, are applied to the substrate 1 simultaneously.

As known to practitioners in the art, a multi-cavity slot die can form a single flow of multiple layers, which is then applied to the substrate. Coating by a multi-cavity slot die is considered to be simultaneous coating of the fluid coating compositions passed through the multi-cavity slot die onto the substrate. Other coating apparatuses that can be used in place of a multi-cavity slot die, such as but not limited to slide coaters and cascade slot die coaters, are known to practitioners in the art.

For sequential coating, two or more single slot dies can be used to deposit separate coating composition layers in sequence on the substrate as it passes the dies. Alternatively, a combination of single slot dies and multi-cavity slot dies, or a plurality of multi-cavity slot dies, can be arranged to effect sequential application of coating composition layers to a substrate. Other coating apparatuses that can be used in place of a single slot die, such as but not limited to gravity feed coaters, are known to practitioners in the art.

A slot die opening height is determined by the rheology of the liquid coating. The slot die opening height is typically from about 5 mils to about 20 mils in height, although smaller or larger slot die openings can be used as appropriate depending on the fluid coating composition, as known to practitioners in the art. The slot die opening effects the slot die head and pump pressures needed to supply the volume of coating required to achieve the desired thickness of coating on the substrate at various line speeds.

The distance from the slot die nose (lips and slot die opening) to the substrate is considered a coating gap. The coating gap can be uniform along the longitudinal length of the lips (cross width of the substrate) or can vary along the longitudinal length of the lips in accordance with different lip geometries, lip machining defects, angled or beveled lips, and adjustment to the angle of attack of the slot die, for example. Typically, the static coating gap is uniform for a given slot die, and the distance between the slot die nose and substrate is adjusted uniformly along the longitudinal length of the slot die to be from about 25 mils to about −100 mils, although larger positive or negative distances may be desirable under certain conditions, as known to practitioners in the art. To compensate for variations in base layer and/or substrate thickness, coating is preferably performed against an unsupported portion of the substrate. Where more than one die is used, as in sequential application of coating layers, typically the first die to apply a fluid coating composition to the substrate is located adjacent an unsupported portion of the substrate. The slot die nose to substrate distance where the substrate is unsupported is from 0 to about −100 mils, and typically from 0 to about −70 mils. Line tension and fluid flow provide operating clearance from the unsupported substrate during coating. The coating gap for each die in a series of dies is independently determined and adjusted, as known to practitioners in the art.

Figure 4:
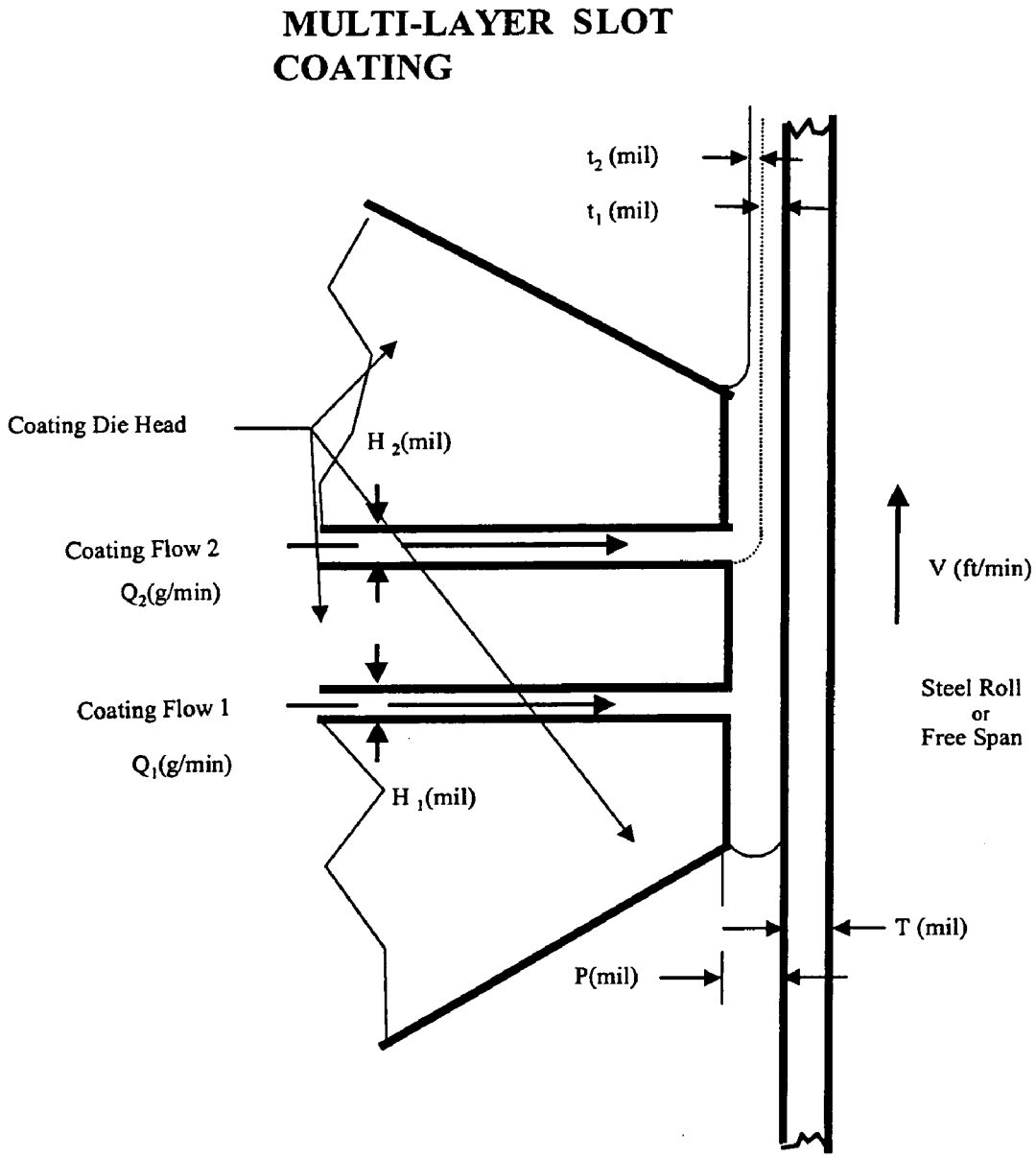
FIG. 4 is a slot die coating apparatus as used in one embodiment of the invention.
Figure 5:
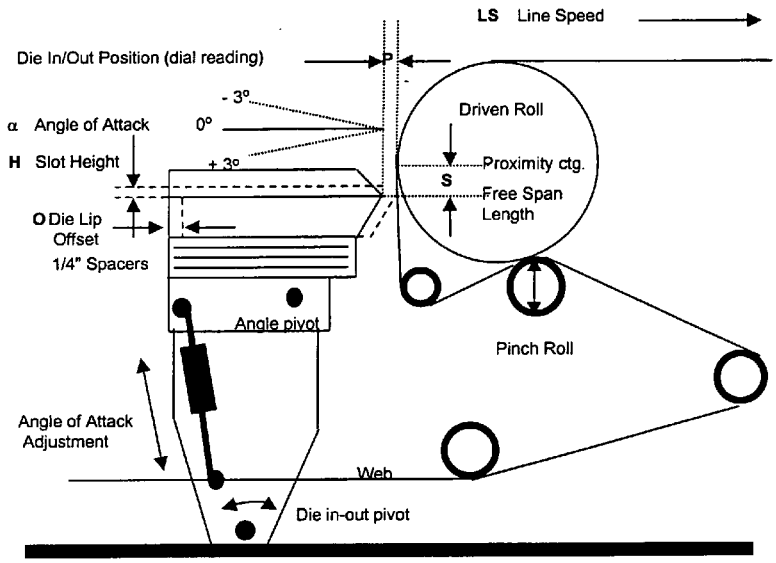
FIG. 5 illustrates a second coating apparatus having a slot die coater as used in one embodiment of the invention.

As shown in FIGS. 4 and 5, a slot die can be mounted to control the positioning of the slot die relative to the substrate being coated. Both the distance of the slot die from the substrate and the angle of attack of the slot die to the substrate can be adjusted. For example, as shown in FIG. 4, the horizontal arrow on slot die 11 indicates that the slot die 11 can be moved radially into or away from the substrate 1 on its base 9 in order to adjust the coating gap. This can be controlled by a slot die in/out pivot 31 as shown in FIG. 5. In addition, the angle of attack of the slot die 11 can be adjusted by adjusting the seat of the slot die 11 using the toggle bolt 33 to raise or lower the seat position at the angle pivot 35 as shown in FIG. 5.

The apparatus for coating the substrate can be arranged in any suitable manner, as determinable by practitioners in the art. Examples of suitable slot die arrangements are set forth in FIGS. 4 and 5.

FIG. 4 illustrates a basic arrangement wherein a single multi-cavity slot die can be used, or a series of single slot dies can be arranged to allow for coating of a plurality of fluid coating compositions on the substrate. In this coating apparatus 29, the fluid coating composition is fed from coating reservoir 9 to the slot die 11. The fluid coating composition travels through the slot die and is applied at the slot die opening to moving substrate 1. Substrate 1 is moved past the slot die 11 by means of rolls 3 and continues once coated to a curing area. The fluid coating composition can be applied to the substrate 1 at any position along the substrate. When a series of slot die coaters is used for sequential coating, additional slot die coaters are located subsequent to the first slot die coater position, typically at the tangent of roll 3 or opposite a supported portion of the substrate. The gap distance between the substrate and the die lips of any subsequent slot die coater is desirably adjusted to avoid contact of the die lips with the first applied wet coating composition layer and to allow for control of the second coating layer thickness. Various physical arrangements can be employed to facilitate gap control as known to practitioners in the art.

In one embodiment, to achieve a uniform thickness of the fluid coating composition along the length of the substrate, the fluid coating composition is applied at a portion of the substrate that is unsupported, for example, a portion of the substrate between the rolls 3. A vacuum pump 7 as known to practitioners in the art can be used to create a vacuum chamber between slot die 11 and substrate 1. The vacuum chamber lowers the pressure between the slot die and substrate, thereby aiding the transfer of the fluid coating composition from the die to the substrate and allowing greater line speeds. Any fluid coating composition pulled into the vacuum chamber is collected in waste collector 5.

Preferably, slot die head and pump pressures are maintained at from about 20 psi to about 100 psi, although greater and lesser pressures can be used as appropriate, as known to practitioners in the art. Any pumps that are known to practitioners in the art and that can handle the viscosity and amount of the fluid coating compositions to be applied can be used. Progressive cavity pumps, such as the Moyno or MonoFlow pump, are best for use with 100% solids coatings such as APR 47, described in U.S. Pat. No. 5,891,582, and Duracoat 4, described in U.S. Pat. No. 5,719,227. Gear pumps are typically used for water-based and solvent-based coatings such as those described in U.S. Pat. Nos. 4,855,165, 4,781,987, and 5,643,677. Instead of a pump, a pressure pot feed can be used for low viscosity coatings so long as a means of flow control is used, as known to practitioners in the art.

FIG. 5 shows an alternate coating apparatus 29. The slot die 11 is positioned on a support 36 that includes one or more spacers 37 for adjusting the position 41 of the slot die along the substrate 1 in relation to the tangent 43 of the substrate and driver roll 47. The support 36 further includes a slot die in/out pivot 31 for adjusting the slot die nose to substrate distance 39, and a means of adjusting the angle of attack. The angle of attack may be adjusted around angle pivot 35, which pivots the spacers and slot die seated thereon in an upward direction (positive angle from the horizontal) in relation to the substrate 1, or in a downward direction (negative angle from the horizontal) in relation to substrate 1 by increasing or decreasing the length of the toggle bolt 33. The substrate 1 is fed past the slot die 11 by a combination of rolls 3, pinch roll 45 and driver roll 47. The coated substrate continues on from driver roll 47 to an area for drying, gelling, curing and/or fusing of the coatings. The one or more fluid coating compositions are applied to the substrate by slot die 11. Each coating is supplied to the slot die from a container 30 by means of a pump 32 which forces the fluid coating composition through inlet tube 34 into the slot die 11 for coating. The fluid coating composition container 30 can be any suitable vessel as known in the art, such as but not limited to a pressure pot. Any suitable commercially available pump known to practitioners in the art, such as but not limited to a MonoFlow pump, can be used for pump 32.

Various commercial die manufacturers provide basic dies with one or more of variable slot die opening height adjustment, streamlined internal flow passages, internal deckles for coating width control, and replaceable, hardened die lips for long life. Die manufacturers providing dies suitable for applying liquid coatings to a substrate to form a decorative surface covering or decorative surface covering component include, but are not limited to, Extrusion Dies Incorporated (EDI), Faustel, CM Technology, BTG Division of Spectris Technology, Epic Corporation International, May Coating Technologies, Rexam Custom Coating and Laminating, Cloeren Inc., Troller Schweizer Engineering SA, and Polytype SA.

Visual inspection of cross-sections of the decorative surface coverings or decorative surface covering components made as described herein and exemplified below demonstrates that the several layers of fluid coating composition applied to a substrate do not mix during application, or before or during curing of the layers. Rather, the coated layers, whether applied simultaneously or in sequence, remain separate and distinct.

Further features and advantages of the invention as described herein and exemplified below will be apparent to practitioners in the art.

EXAMPLES

Examples 1 and 2 demonstrate sequential coating of wet on wet layers wherein at least one layer is a plastisol.

Example 1

This experiment demonstrates that four plastisol layers can be applied wet-on-wet using a gravity fed multi-cavity slot die and simultaneously gelled and fused without layer intermixing. The plastisol formulations were similar to those described in Example 1 of U.S. Pat. No. 5,223,322. As shown in FIG. 6, four gravity fed, open bottom hoppers 49 were constructed of sheet aluminum and arranged in tandem such that the downstream bottom was 10 mils above the downstream bottom of the preceding hopper. The hoppers were mounted above a release paper web 1. The applied coatings were processed through an air impingement oven equipped with a continuous belt designed for gelling and fusing plastisols. The line was started at 20 ft/min and Hopper 1 was charged with a typical formula of a foamable plastisol 51 with a Brookfield viscosity of 600 cPs. As soon as a plastisol film was formed, Hopper 2 was charged with a typical formula of clear PVC plastisol 53 with a Brookfield viscosity of 500 cPs. The plastisol from Hopper 2 formed a layer on top of that layer generated from Hopper 1. Similarly, Hopper 3 was charged with the same foamable plastisol 51 as that contained in Hopper 1. After this layer was formed, Hopper 4 was charged with the clear formula plastisol 53 used in Hopper 2. The resulting four-layer composite was gelled and fused in the air impingement oven in a manner known to those skilled in the art similar to that used for single layer PVC plastisols.

The fused structure was examined in cross-section under a microscope and found to be composed of four discrete 10 mil-thick layers of alternating clear and foamed plastisol. The layer thickness and foam structure of the foamable layers were comparable to single layer foamable plastisols coated, gelled and fused individually. The clear layers were well fused and did not exhibit any disruption from the foam expansion of the underlying foam layers.

Example 2

A 10 mil thick wet drawdown of a clear plastisol 51 of Example 1 was prepared on release paper supported on a vacuum table. Immediately, the release paper coated with liquid plastisol film was mounted in a drawdown frame of a Mathis oven and a second drawdown of an water-based topcoat formulation corresponding to Example 13 of U.S. No. Pat. 4,781,987, was applied on top of the wet plastisol using the drawdown device mounted on the Mathis Oven. The percent solids of the topcoat formulation was adjusted to yield 37.5% solids coating with viscosity range of 2500 to 3500 cPs. The thickness of the second wet drawdown was 1.5 mils. The resulting wet on wet layers were cured in the Mathis Oven for 2 minutes at a temperature of 400° F. The resulting decorative surface covering was smooth and glossy with discrete layers of 10 mils cured plastisol and 0.5 mils of cured water-based topcoat.

The adhesion of the topcoat layer was tested by cross-hatch cutting followed by tape pull as known to those skilled in the art and was found to have excellent adhesion to the plastisol layer. The stain resistance of the cured water-based topcoat was found to be similar to that of the cured water-based topcoat coated onto pre-gelled plastisol and cured in the conventional manner.

Examples 3-6 demonstrate various fluid coating compositions that can be used in the methods and preparation of the materials of the invention. Further, Examples 3-6 demonstrate the differences in uniformity achieved when the coating layer is applied to a supported substrate (Examples 4 and 5) as compared to an unsupported substrate (Examples 3 and 6).

Example 3

An experiment was conducted using a 6" wide single cavity die as shown in FIGS. 2A and 2B. The high performance topcoat formulation corresponded to Example 13 of U.S. Pat. No. 4,781,987, adapted to yield a 37.5% solids coating with a Brookfield room temperature viscosity of 3,425 cPs. The substrate was an unexpanded flooring substrate consisting of 25 mils of a felt backing, 15 mils of gelled foamable plastisol, and 20 mils of gelled, vinyl plastisol wear layer.

The slot die 11 was mounted on a coating stand as shown in FIG. 5 so that the slot die nose was positioned 1.75" below the backing roll tangent and driven roll at a slot die angle of attack of 0 degrees to the substrate. The slot die was fed by a MonoFlow LF Range Low Flow Metering Pump Model SLF20241V5/E. The suction side of the pump was fed by a DeVillbis Pressure Pot pressurized with air to 20 psi. The slot die opening height was 4 mils established by shim thickness. The pump speed was set to 30% of fall speed to deliver 1.33 mils of wet coating at a line speed of 20 ft/min. The slot die nose to substrate gap was set to minus 70 mils (−70 mils) to provide operating clearance that was controlled by fluid flow and line tension.

These settings produced a dry film thickness of 0.663 mils as determined after curing by cross sectioning and measuring the film thickness using a Leica Laborlux 12 microscope, 200× magnification, color camera and Boechler Thickness Measurement System. Scanning of the profile across machine direction showed the coated film to be uniform in thickness.

Example 4

The experiment was conducted using a 6" wide single cavity die 23 as shown in FIGS. 2A and 2B, mounted as shown in FIG. 5. A 100% solids urethane acrylate coating corresponding to Example 1 of U.S. Pat. No. 5,719,227 was coated on a 3 mil thick rigid vinyl film made by Klockner. The coating was adjusted so that the reactive diluent level was increased to provide a coating with a Brookfield room temperature viscosity of 5,000 cPs. The slot die opening height was set to 15 mils using shims and the slot die coater was positioned to coat at the backing roll tangent point. The slot die to substrate distance was set at 7 mils. The angle of attack was set to 3 degrees. Line speed was 30 ft/min and the pump speed was set to 20% of full to provide 1.0 mil wet coating. At these settings, slot die head pressure was 120 psi. The applied coating was cured using ultraviolet lamps with a power setting of 0.4 J/cm$^2$. The measured cured coating film thickness was 1.01 to 1.05 mils, measured as described in Example 3.

Example 5

This experiment was conducted in the manner described in Example 4. A 100% solids UV curable coating corresponding to Example 1 of U.S. Pat. No. 5,719,227 was coated on a Mylar film substrate. The 100% solids coating had a room temperature viscosity of 17,640 cPs. The slot die opening height was set at 15 mils. The line speed was 40 ft/min and the pump speed was set at 30% of maximum to deliver 1.0 mil of wet coating. The resulting slot die head pressure was 225 psi. The pressure pot was charged to 40 psi to deliver coating to the suction side of the MonoFlow pump. The angle of attack was zero degrees. The applied coating was then cured by ultraviolet radiation of 0.4 J/cm$^2$ using ultraviolet lamps with a power setting of 0.4 J/cm$^2$. The thickness of the cured coating was 0.945 to 0.984 mils, measured as described in Example 3.

Example 6

This experiment used a commercially available 14" wide Ultracoat Flexlip die manufactured by Extrusion Dies Incorporated. The slot die was fitted with wide land (300×300 mil) slot die lips. The coating was a water-based topcoat formulation corresponding to Example 13 of U.S. Pat. No. 4,781,987, adjusted to provide a coating with a Brookfield viscosity of 2,000 cPs. The flooring substrate coated consisted of a 10 mil felt backing, a 25 mil melt calendared PVC layer, 6 mils of gelled, foamable plastisol, and 10 mils of gelled transparent PVC plastisol wear layer before fusion and expansion. The gelled plastisol surface was smooth.

The slot die was mounted on a stand as depicted in FIG. 5, and was positioned 1.75" below the backing roll tangent. The slot die opening height was set by Flexlip adjustment to 7.5 mils. Line speed was 20 ft/min and the pump was set at 50% of full speed to deliver 90 grams/minute, or a 1.3 mil wet coating. The angle of attack was set at minus 1 degree and the slot die to substrate distance was negative 50 mils (−50 mils). For this run, a 50 micron filter was installed at the slot die inlet to remove any small particles and minimize coating defects. The coated product was fused, cured and expanded in an air impingement oven by air Egan. The cured product showed a uniform topcoat thickness of 0.50 mils (+/−0.05 mils) and good stain and abrasion resistance comparable to the same water-based topcoat applied by roll coating and cured by the conventional process.

Examples 7-9 demonstrate embodiments wherein at least one layer includes a plastisol and wherein the coating layers are applied simultaneously.

Example 7

A 12" dual cavity slot die is used as depicted in FIG. 3. The slot die is positioned to coat adjacent to the tangent of the backing roll, where the substrate is unsupported. A release paper substrate is conveyed under the dual cavity die. The clear PVC plastisol fluid coating composition of Example 1 is fed through the lower die cavity and the die adjusted to produce a 20 mil wet coating thickness. The upper cavity is fed with the water-based topcoat formulation of Example 6. The feed rate is adjusted to produce a 1.33 mil wet topcoat thickness on top of the 20 mil clear plastisol layer. Subsequently, the wet on wet composite coating is passed through an air impingement oven where the plastisol gels, the water-based coating dries, and both layers cure. Final stain and adhesion properties of the topcoat/PVC wear layer composite is the same as that obtained by coating and curing the water-based topcoat on a previously gelled PVC wear layer on a release paper substrate.

Example 8

The same dual cavity die and clear plastisol wear layer of Example 7 is employed. However, instead of the water-based topcoat formulation, the 100% solids topcoat of Example 4 is fed into the upper die cavity and the feed-rate adjusted to provide a 20 mil wet plastisol and a 1 mil wet 100% solids topcoat composite coating. The composite coating is heated by passing through an air impingement oven to gel and fuse the PVC layer. Subsequently, the 1 mil topcoat is cured by exposure to ultraviolet radiation after it exits the air impingement oven.

Example 9

The dual cavity die of Example 7 is used, and the foamable plastisol formulation of Example 1 is fed into the lower die cavity and the clear PVC plastisol wear layer formulation of Example 1 is fed into the upper die cavity. A 25 mil flooring felt carrier is conveyed under the dual cavity die. Flow rates are adjusted to produce a 10 mil wet foamable plastisol layer and 10 mil wet clear plastisol wear layer composite coating on the felt substrate. Subsequently, the composite coating is gelled and fused and expanded by passing the coated carrier through an air impingement oven at 390° F.

Examples 10 and 11 demonstrate embodiments wherein at least one layer includes a 100% solids composition and wherein the coating layers are applied simultaneously.

Example 10

The dual cavity die of Example 7 is used to produce a composite high performance topcoat layer. The 100% solids UV curable coating of Example 5 is fed into the bottom die cavity and gap and flow rate adjusted to apply a 1 mil wet film onto a substrate of the rigid vinyl film of Example 4. The upper die cavity is fed with the high Tg, 100% solids formulation of Example 6 of U.S. Pat. No. 5,494,707, and flow rate adjusted to deliver a 1 mil wet coating. The resultant 2 mil composite topcoat was subsequently cured by ultraviolet radiation to produce a high performance composite topcoat layer.

Example 11

This is a repeat of Example 10, except that the upper die cavity is fed with the Organic/Inorganic topcoat formulation corresponding to Example 1 of U.S. Pat. No. 5,120,811, and the flow rate adjusted to give a 1 mil wet coating thickness of the Organic/Inorganic coating on top of the 1 mil wet 100% solids UV curable coating. The wet on wet composite coating is dried by heating at 150° F. and under high airflow, and subsequently cured by ultraviolet radiation. Improvement in stain resistance and gloss retention of the composite coating over a 100% solids UV coating alone is observed.

While certain embodiments or the invention have been presented herein by way of example, it is understood by practitioners in the art that modifications and/or substitutions of materials, methods and apparatus are possible while remaining within the scope and spirit of the invention. The invention thus is not limited to the embodiments described herein but is intended to cover all modifications coming within the scope of the appended claims.

What is claimed is:

1. A method of forming a floor covering or floor covering component on a substrate, wherein the floor covering or floor covering component prior to curing comprises a plurality of superposed, separate and distinct fluid coating compositions, the method comprising:

a) obtaining a plurality of curable fluid coating compositions, wherein at least one fluid coating composition comprises a 100 percent solids composition, said 100 percent solids being fluid at room temperature, and b) applying each fluid coating composition onto a substrate to form a plurality of separate and distinct layers directly or indirectly overlying the substrate, wherein the fluid coating compositions are applied to the substrate simultaneously with a multi-cavity slot die coater.

2. The method of claim 1, further comprising:

c) curing or partially curing each fluid coating composition after the plurality of curable fluid coating compositions are applied.

3. The method of claim 1, wherein at least one of the plurality of fluid coating compositions is thermally curable.

4. The method of claim 1, wherein each layer ranges from about 1.0 mil to about 25 mils wet thickness.

5. A method of forming a floor covering or floor covering component on a substrate, wherein the floor covering or floor covering component prior to curing comprises a plurality of superposed, separate and distinct fluid coating compositions, the method comprising:

a) obtaining a plurality of curable fluid coating compositions, wherein at least one fluid coating composition comprises a 100 percent solids composition, said 100 percent solids being fluid at room temperature, and b) applying each fluid coating composition onto a substrate to form a plurality of separate and distinct layers directly or indirectly overlying the substrate, wherein the fluid coating compositions are applied to the substrate simultaneously with a multi-cavity slot die coater, and wherein the plurality of fluid coating compositions are applied to the substrate at a point opposite where the substrate is between two adjacent supports.

6. The method of claim 1, wherein at least one of the plurality of fluid coating compositions comprises a water-based composition.

7. The method of claim 1, wherein the fluid coating composition other than the 100 percent solids fluid coating composition is a fluid plastisol at room temperature.

8. A method of forming a floor covering or floor covering component on a substrate, wherein the floor covering or floor covering component prior to curing comprises a plurality of superposed, separate and distinct fluid coating compositions, the method comprising:

a) obtaining a plurality of curable fluid coating compositions, wherein at least one fluid coating composition is a fluid plastisol at room temperature, and b) applying each fluid coating composition onto a substrate to form a plurality of separate and distinct layers directly or indirectly overlying the substrate, wherein the fluid coating compositions are applied to the substrate at room temperature and simultaneously with a multi-cavity slot die coater.

9. The method of claim 8, further comprising:

c) curing or partially curing each fluid coating composition after the plurality of curable fluid coating compositions are applied.

10. The method of claim 8, wherein at least one of the plurality of fluid coating compositions is curable by ultraviolet radiation.

11. The method of claim 8, wherein at least one of the plurality of fluid coating compositions is thermally curable.

12. A method of forming a floor covering or floor covering component on a substrate, wherein the floor covering or floor covering component prior to curing comprises a plurality of superposed, separate and distinct fluid coating compositions, the method comprising:

a) obtaining a plurality of curable fluid coating compositions, wherein at least one fluid coating composition is a fluid plastisol at room temperature, and b) applying each fluid coating composition onto a substrate to form a plurality of separate and distinct layers directly or indirectly overlying the substrate, wherein the fluid coating compositions are applied to the substrate simultaneously with a multi-cavity slot die coater, and wherein the plurality of fluid coating compositions is applied to the substrate at a point opposite where the substrate is between two adjacent supports.

13. The method of claim 8, wherein at least one of the plurality of fluid coating compositions comprises a water-based composition.

14. A method of making a floor covering or floor covering component comprising a wear layer and a topcoat, the method comprising:

a) applying wet-on-wet, at room temperature, at least one wear layer composition and at least one topcoat composition to the surface of a floor covering element; and b) curing or partially curing each of the at least one wear layer composition and at least one topcoat composition, wherein the at least one wear layer composition and at least one topcoat composition are applied to the substrate simultaneously with a multi-cavity slot die coater.

15. The method of claim 14, wherein at least one wear layer composition is a fluid plastisol at room temperature.

16. The method of claim 14, wherein at least one wear layer composition is thermally curable.

17. The method of claim 14, wherein at least one topcoat composition is thermally curable.

18. The method of claim 14, wherein the topcoat ranges from about 1.0 mil to about 5 mils wet thickness.

19. The method of claim 14, wherein at least one topcoat composition is curable by ultraviolet radiation.

20. The method of claim 14, wherein at least one topcoat composition comprises a water-based composition.

21. The method of claim 14, wherein the floor covering component comprises a foamable layer and the foamable layer is foamed during curing of at least one wear layer composition or topcoat composition.

22. A method of making a floor covering comprising a high performance topcoat, the method comprising:

a) applying a plurality of topcoat compositions in wet state to a floor covering component comprising a wear layer; and b) curing the plurality of topcoat compositions to form a high performance topcoat on a floor covering, wherein the plurality of topcoat compositions is applied to the substrate simultaneously with a multi-cavity slot die coater, and wherein the topcoats are applied to the substrate at a point opposite where the substrate is between two adjacent supports, wherein at least one of the plurality of topcoat compositions comprises a 100 percent solids composition, said 100 percent solids being fluid at room temperature.

23. The method of claim 22, wherein the plurality of topcoat compositions comprises at least one solvent-based composition.

24. A method of making a floor covering or floor covering component comprising a wear layer and a topcoat, the method comprising:

a) applying wet-on-wet, at room temperature, at least one wear layer composition and at least one topcoat composition to the surface of a floor covering element; and b) curing each of the at least one wear layer composition and at least one topcoat composition, wherein the at least one wear layer composition and at least one topcoat composition are applied to the substrate simultaneously with a multi-cavity slot die coater, and wherein the wear layer and topcoat are applied to the substrate at a point opposite where the substrate is between two adjacent supports.

25. The method of claim 1, wherein at least one of the plurality of fluid coating compositions is curable by ultraviolet radiation.

26. The method of claim 8, wherein each layer ranges from about 1.0 mil to about 25 mils wet thickness.

27. The method of claim 14, wherein each layer ranges from about 10 mils to about 25 mils wet thickness.

28. The method of claim 1, wherein at least one of the plurality of fluid coating compositions is curable by ultraviolet radiation.

29. The method of claim 5, wherein at least one of the plurality of fluid coating compositions is curable by ultraviolet radiation.

30. The method of claim 5, wherein the fluid coating compositions are applied to the substrate at room temperature.

31. The method of claim 5, further comprising:

c) curing or partially curing each fluid coating composition after the plurality of curable fluid coating compositions are applied.

32. The method of claim 5, wherein at least one of the plurality of fluid coating compositions is thermally curable.

33. The method of claim 5, wherein each layer ranges from about 1.0 mil to about 25 mils wet thickness.

34. The method of claim 5, wherein at least one of the plurality of fluid coating compositions comprises a water-based composition.

35. The method of claim 5, wherein a fluid coating composition other than the 100 percent solids fluid coating composition is a fluid plastisol at room temperature.

36. The method of claim 12, wherein at least one of the plurality of fluid coating compositions is curable by ultraviolet radiation.

37. The method of claim 12, further comprising:

c) curing or partially curing each fluid coating composition after the plurality of curable fluid coating compositions are applied.

38. The method of claim 12, wherein at least one of the plurality of fluid coating compositions is thermally curable.

39. The method of claim 12, wherein each layer ranges from about 1.0 mil to about 25 mils wet thickness.

40. The method of claim 12, wherein at least one of the plurality of fluid coating compositions comprises a water-based composition.

41. The method of claim 12, wherein the fluid coating compositions are applied to the substrate at room temperature.

42. A method of making a floor covering comprising a high performance topcoat, the method comprising:

a) applying a plurality of topcoat compositions in wet state to a floor covering component comprising a wear layer; and b) curing the plurality of topcoat compositions to form a high performance topcoat on a floor covering, wherein the plurality of topcoat compositions is applied to the substrate simultaneously with a multi-cavity slot die coater, and wherein the topcoats are applied to the substrate at a point opposite where the substrate is between two adjacent supports, wherein the topcoat compositions are applied to the substrate at room temperature.

43. A method of forming a floor covering or floor covering component on a substrate, wherein the floor covering or floor covering component prior to curing comprises a plurality of superposed, separate and distinct fluid coating compositions, the method comprising:

a) obtaining a plurality of curable fluid coating compositions, and b) applying each fluid coating composition onto a substrate to form a plurality of separate and distinct topcoat layers directly or indirectly overlying the substrate.

wherein the plurality of topcoat compositions are applied to the substrate simultaneously with a multi-cavity slot die coater, wherein the plurality fluid coating compositions is applied to the substrate at a point opposite where the substrate is between two adjacent supports, and wherein the fluid coating compositions are applied to the substrate at room temperature.

* * * * *